US010126056B2

(12) United States Patent
Shea

(10) Patent No.: US 10,126,056 B2
(45) Date of Patent: Nov. 13, 2018

(54) THERMOPLASTIC MELTING KETTLE MATERIAL CIRCULATION SYSTEM

(71) Applicant: James P. Shea, Waterford, MI (US)

(72) Inventor: James P. Shea, Waterford, MI (US)

( * ) Notice: Subject to any disclaimer, the term of this patent is extended or adjusted under 35 U.S.C. 154(b) by 0 days.

(21) Appl. No.: 15/424,461

(22) Filed: Feb. 3, 2017

(65) Prior Publication Data

US 2017/0299265 A1 Oct. 19, 2017

Related U.S. Application Data

(60) Provisional application No. 62/322,640, filed on Apr. 14, 2016.

(51) Int. Cl.

| | |
|---|---|
| ***C10C 3/12*** | (2006.01) |
| ***F27D 3/00*** | (2006.01) |
| ***F27D 3/06*** | (2006.01) |
| ***C10C 3/10*** | (2006.01) |
| *E01C 23/20* | (2006.01) |

(52) U.S. Cl.

CPC ..... *F27D 3/0025* (2013.01); *C10C 3/10* (2013.01); *C10C 3/12* (2013.01); *F27D 3/06* (2013.01); *E01C 23/206* (2013.01)

(58) Field of Classification Search

CPC ..... B05C 5/001; B29B 13/022; B65D 88/74; C02F 2201/008; E01H 5/102; E04D 15/07; F04B 19/12; C10C 3/12; F27B 14/00; F27B 2014/002

USPC ..... 126/343.5 A, 343.5 R

See application file for complete search history.

(56) References Cited

U.S. PATENT DOCUMENTS 1,533,390 A * 4/1925 Coleman ..... C10C 3/12 126/343.5 A
1,855,961 A * 4/1932 Hargrave ..... C10C 3/12 126/343.5 A
2,038,221 A * 4/1936 Kagi ..... B22D 43/00 266/235
2,181,686 A * 11/1939 Walker ..... C10G 33/06 126/343.5 A
2,317,704 A * 4/1943 Winter ..... A21B 5/08 99/408
2,439,367 A * 4/1948 Middlestadt ..... C10C 3/12 126/343.5 A
2,593,768 A * 4/1952 Kohn ..... C10C 3/12 126/343.5 A
2,607,337 A * 8/1952 Miller ..... F23K 5/20 122/140.1

(Continued)

*Primary Examiner* — Jorge Pereiro
(74) *Attorney, Agent, or Firm* — Brinks Gilson & Lione

(57) ABSTRACT

A molten thermoplastic circulation system that is used in conjunction with thermoplastic melter kettles. The molten circulation system includes a vertical material transfer tube that is coupled to a melter kettle and includes an auger. The vertical material transfer tube is coupled to the top and bottom of a melter kettle so as to transfer molten thermoplastic between the bottom and top of the melter kettle. The vertical material transfer tube is at least partially surrounded by a heat chamber through which a heated fluid such as hot combustion gases or heated oil can flow. In use molten thermoplastic material that is heated at a higher temperature at the bottom of a melter kettle near the combustion chamber is transferred through the vertical material transfer tube to the top of the melter kettle to improve melting efficiency.

20 Claims, 7 Drawing Sheets

(56) References Cited

U.S. PATENT DOCUMENTS 2,613,665 A * 10/1952 Miller ..... C10C 3/12 126/343.5 A
2,648,264 A * 8/1953 Green ..... E01C 19/17 126/343.5 A
2,692,124 A * 10/1954 Mendoza ..... A21C 1/065 198/580
3,129,927 A * 4/1964 Mast ..... A01K 5/0216 366/157.2
3,768,782 A * 10/1973 Clelland ..... G21F 9/22 366/133
3,946,722 A * 3/1976 Banahan ..... E01C 19/174 126/343.5 A
4,019,830 A * 4/1977 Reid ..... F04D 3/02 415/124.1
4,222,704 A * 9/1980 Reid ..... F04D 3/02 384/549
4,239,449 A * 12/1980 Bauer ..... F04B 19/12 415/73
4,328,787 A * 5/1982 Bruff ..... C10C 3/10 126/343.5 A
4,462,547 A * 7/1984 Metz ..... E01C 23/166 165/146
4,534,493 A * 8/1985 Sedran ..... B05C 11/1042 222/146.2
5,529,212 A * 6/1996 Terhardt ..... B01F 7/00208 222/1
6,012,447 A * 1/2000 Waxler ..... B01F 7/168 126/284
6,109,826 A * 8/2000 Mertes ..... E01C 19/45 392/472
6,736,129 B1 * 5/2004 Smith ..... E01H 5/102 126/343.5 R
7,845,314 B2 * 12/2010 Smith ..... B01D 1/0058 122/31.2
9,771,691 B2 * 9/2017 Howseman, Jr. ..... E01C 11/24
2001/0003563 A1 * 6/2001 Schauer ..... B05C 17/002 401/5
2004/0050678 A1 * 3/2004 Takahashi ..... C10G 1/10 202/108
2009/0305181 A1 * 12/2009 Kurata ..... B01D 1/0047 432/13
2011/0253124 A1 * 10/2011 Shea ..... E01C 23/206 126/343.5 A
2017/0218575 A1 * 8/2017 Howseman, Jr. ..... D21H 27/02

* cited by examiner

THERMOPLASTIC MELTING KETTLE MATERIAL CIRCULATION SYSTEM

RELATED APPLICATION

The present application is based upon U.S. Provisional Application Ser. No. 62/322,640, filed Apr. 14, 2016 to which priority is claimed under 35 U.S.C. § 120 and of which the entire specification is hereby expressly incorporated by reference.

BACKGROUND

The present invention relates generally to melter kettles that are designed and used to melt thermoplastic materials that are applied to pavements such as roadways, airport runways, parking lots, bicycle paths and other surfaces requiring pavement markings. More particularly the present invention is directed to systems and methods to improve the melting efficiency of melter kettles.

A variety of thermoplastic materials and compositions have been developed and used in the roadway striping industry. In order to apply such thermoplastic materials and compositions, they have to be melted and mixed. Melting, which involves both initial melting from solid stock or feed materials and maintaining the materials/compositions in a molten state for application onto roadways and other pavements, is typically conducted in melter kettles (also referred to herein as "melting kettles") which can be heated by electrical means, or by burning combustible fuels.

Thermoplastic materials/compositions are the current products of choice for many types of marking applications. However, unlike most other types of marking materials thermoplastic materials/compositions must be melted for use. Thermoplastic materials/compositions can be applied by various methods such as spraying, extruding, and screeding. In order to be applied to pavement surfaces the thermoplastic materials/compositions need to be melted and heated to a sufficiently high temperature so as to adjust their viscosity as needed for a particular type of application process. In addition the temperature has to be controlled to avoid scorching, cooking, baking or breaking down.

Thermoplastic materials/compositions must be melted to very high temperatures that can reach up to 400° F. in order to be fluid enough to be applied using current pavement marking equipment. Early types of thermoplastic application equipment applied thermoplastic at slow rates. Therefore, long thermoplastic melting times required in the past to melt thermoplastic materials/compositions in melter kettles were not a problem. Melter kettles could keep up with low output application equipment.

Over time improvements in melter kettle designs were developed which reduced melting times. Eventually improvements in application equipment were developed which enabled thermoplastic materials to be applied at much faster rates. Soon it was recognized that the rate of melting thermoplastic in kettles was not keeping up with improvements in application equipment that increased the rate at which the thermoplastic material can be applied. While methods of application and equipment development have increased, the rate of application production melting capacity has lagged far behind the ability to apply the material.

For some time heat domes, also called heat risers or heat tubes, have been installed in melter kettles. A heat dome is formed by attaching a tube of variable diameter to a hole in the base of a kettle where the OD of the dome base matches the ID of the hole in the base of the kettle. The top of the dome is closed by a metal disc. The dome reduces the heating surface area of the base of the kettle; however, the dome provides additional circumference surface area that compensates for the loss of the heating area in a melter kettle with no dome within a few inches of dome height. Heat domes increase the heated surface area of melter kettles that is in contact with thermoplastic materials as compared to melter kettles that do not have heat domes thereby increasing the heat transfer into the thermoplastic materials in the kettles. This increases the ratio of heat transfer area to thermoplastic volume which improves heating efficiency.

An additional advantage of heat domes is that they provide for heating thermoplastic materials from the center of a melter kettle. Heating thermoplastic material in a melter kettle from the center of the kettle in an outwardly direction is more efficient than heat transfer from the outside of the kettle in an inward direction.

The use of heat domes in melter kettles has reduced melting times in kettles. However, heated air in heat domes cools as heat is transferred through the dome wall and top into the thermoplastic material being heated. This phenomenon limits the efficiency of heat domes. While melting times are reduced with the use of domes, further improvement is desirable.

The present inventor has recently developed a heat dome temperature regulating system that improves the melting efficiency of heat domes in melter kettles. The system, the subject matter of a copending patent application, includes a heat dome chimney stack tube that is attached to the top center of the heat dome around which an agitator drive shaft tube rotates. Heat travels from the heat dome up the center of the heat dome chimney stack tube and vents out of a top tube drive shaft heat chamber that is provided with an adjustable venting arrangement. This system exhausts air from the heat dome that has been heat depleted thereby allowing a continual flow of air heated to its maximum efficient temperature into the dome such that the maximum amount of heat is transferred through the heat dome and through the surfaces of the heat dome chimney stack tube into the thermoplastic material in the melter kettle. In this system the heat dome chimney stack tube and rotational drive shaft become heating surfaces that extend through the centerline of the kettle.

The present invention further increases the efficiency of melting thermoplastic materials in melter kettles.

BRIEF SUMMARY

According to various features, characteristics and embodiments of the present invention which will become apparent as the description thereof proceeds, the present invention provides an improvement for melter kettles which improvement comprises a molten thermoplastic circulation system coupled to a melter kettle, the molten thermoplastic circulation system comprising:

- a vertical material transfer tube in fluid communication with the bottom and top of the melter kettle and having an auger therein for transferring molten thermoplastic material between the bottom and top of the melter kettle; and
- a heat chamber surrounding at least a portion of the vertical material transfer tube through which a heated fluid flows.

The present invention further provides a melter kettle for melting thermoplastic pavement marking material in combination with molten thermoplastic circulation system, wherein the molten thermoplastic circulation system comprises:

a vertical material transfer tube coupled to a side of the melter kettle and in fluid communication with the bottom and top of the melter kettle and having an auger therein for transferring molten thermoplastic material between the bottom and top of the melter kettle; and a heat chamber surrounding at least a portion of the vertical material transfer tube through which a heated fluid flows.

The present invention also provides a method of melting a thermoplastic material in a melter kettle having a combustion chamber, said method comprising:

charging thermoplastic material into the melter kettle;

combusting a fuel source in the combustion chamber to heat and melt the thermoplastic material in the melter kettle;

providing a molten thermoplastic circulation system having a vertical material transfer tube that is at least partially surrounded by a heat chamber;

transporting molten thermoplastic material from the bottom of the melter kettle through the vertical material transfer tube and then into the top of the melter kettle.

BRIEF DESCRIPTION OF THE DRAWINGS

The present invention will be described with reference to the attached drawings which are given as non-limiting examples only, in which.

DETAILED DESCRIPTION OF THE DRAWINGS AND THE PRESENTLY PREFERRED EMBODIMENTS

Figure 1:
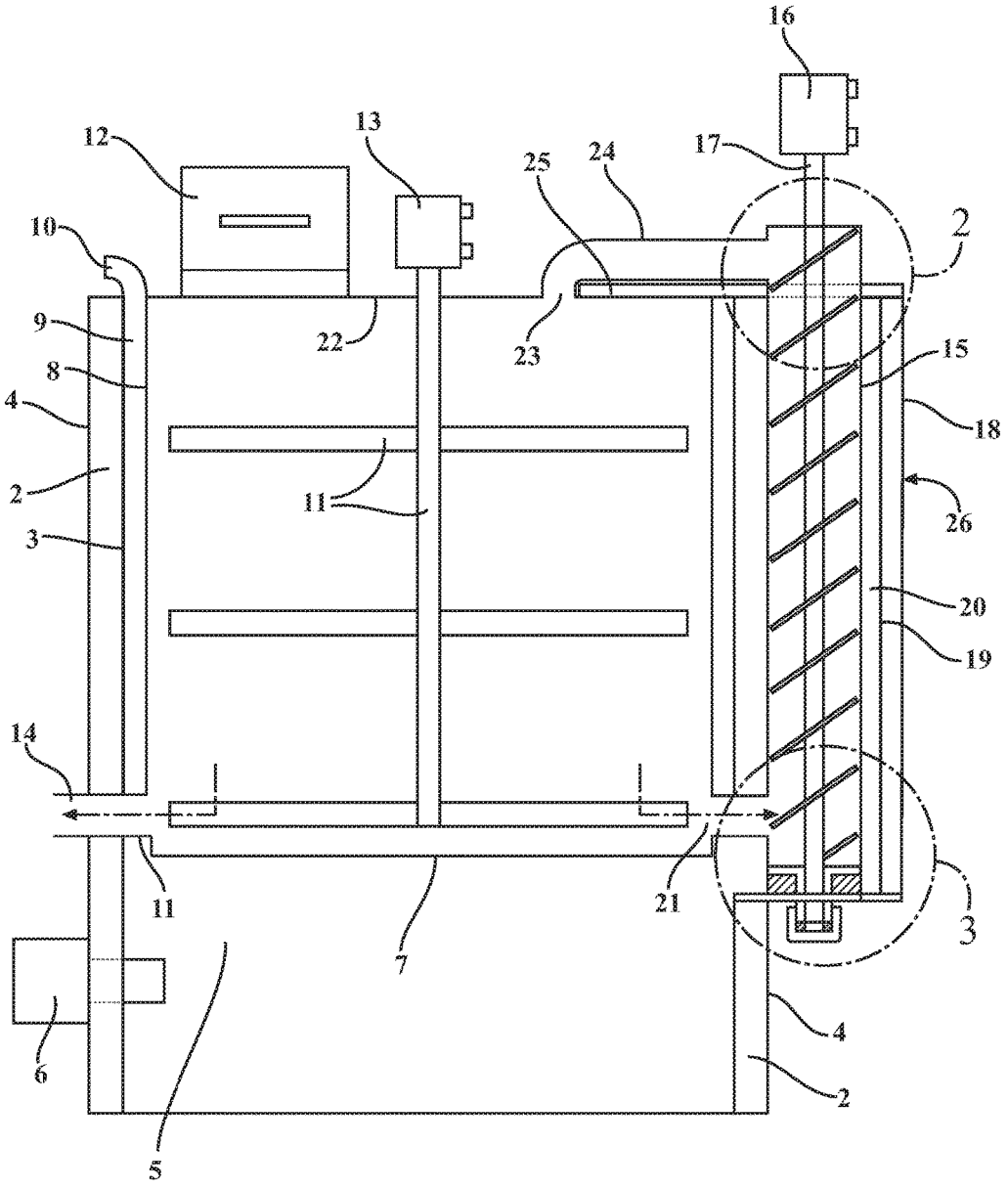
FIG. 1 is a cut away side view of a thermoplastic melter kettle having a thermoplastic melting kettle circulation system according to one embodiment of the present invention.

The present invention provides systems and methods that improve the melting efficiency of melter kettles, including auxiliary heaters that comprise heat exchangers. The present invention is applicable to melter kettles having heat domes and melter kettles that do not have heat domes. The systems and methods of the present invention reduce the melting time of thermoplastic pavement marking materials that are melted in thermoplastic melter kettles. The melter kettles can be stationary, mounted on support trucks, support trailers or on truck mounted thermoplastic application vehicles where the vehicle includes an applicator for marking pavements with the thermoplastic material.

The present invention is based partially on the recognition that material melts at a faster rate at the bottom of a melter kettle, that there is a temperature gradient between the base and sides, and that there is a temperature gradient from the bottom of the sides to the top of the sides. In addition the present invention takes advantage of the fact that material in a kettle melts most efficiently at the bottom and more efficiently from the center of the kettle towards the sides than from the sides towards the center. Therefore, while a standard kettle can be used with this invention, using a kettle with a heat dome and the heat dome temperature regulation system described in the inventor's copending application provides a rate of melting that will be greatly improved.

The present invention increases the rate of melting in two novel ways. First the rate of heating will be increased when the thermoplastic material reaches a viscosity where it will enter the thermoplastic melting kettle circulation system intake at the base of the kettle where the material is hottest and be able to move through the vertical thermoplastic material transfer tube by action of a rotating auger to the top of the circulation system where it is deposited onto and mixed by action of agitators with the cooler thermoplastic material at the top of the kettle. When a heat dome and chimney stack tube are included they greatly increase the rate of heating in the base of the kettle such that the material being introduced at the top of the kettle transfers more heat to the material at the top of the kettle thereby reducing melting time as compared to a melter kettle without a heat dome.

Another novel aspect of this invention is based upon the principal of heat exchange. The action of heating material by moving material from the bottom of the kettle to the top of the kettle where material is added and therefore coolest is passive. According to one embodiment of the present invention the melting kettle circulation system of the present invention can be considered a passive system whereby residual heat from the combustion chamber of a melter kettle is used to transfer heat into the molten thermoplastic material in the vertical material transfer tube. In another embodiment the melting kettle circulation system of the present invention can be considered a dynamic system whereby heated oil or combustion gas is circulated around the vertical material transfer tube so that heat from the heated oil or combustion gas is transferred into the molten thermoplastic material in the vertical material transfer tube.

The addition and use of the melting kettle circulation system in conjunction with a thermoplastic melter kettle makes it now possible to keep up with the rate of application of thermoplastic from high output application equipment.

FIG. 1 is a cut away side view of a thermoplastic melter kettle having a thermoplastic melting kettle circulation system according to one embodiment of the present invention. The thermoplastic melter kettle 1 depicted in FIG. 1 has a cylindrical shape with an annular insulation chamber 2 defined between an outer kettle wall 3 and an outer heat chamber wall 4. The insulation chamber 2 is provided to contain heat within the melter kettle 1 and protect personnel coming into contact with the melter kettle 1 from getting burned. A combustion chamber 5 is provided at the bottom of the melter kettle 1. A burner 6 directs a flame into the combustion chamber 5 that heats the bottom 7 of the melter kettle 1. The combustion chamber 5 includes appropriate air vents (not shown) that allow sufficient air into the chamber to support a burner flame that can be produced by burning a combustible fuel such as propane or diesel fuel.

Combustion heat generated in the combustion chamber 5 heats the bottom 7 of the melter kettle 1. The outer kettle wall 8 is also heated as hot combustion gases travel up the annular kettle side heat chamber 9. Heat depleted combustion gases exit the kettle side heat chamber 9 through exhaust stack(s) 10 located at the top of the kettle side heat chamber 9.

The kettle bottom 7 is the hottest surface of the kettle assembly and transfers more heat upward into the thermoplastic material above the kettle bottom 7 than any other heating surface of the kettle assembly thereby causing the thermoplastic material within the melter kettle 1 to be the hottest at the kettle bottom 7. As the hot gases formed in the combustion chamber 5 flow across the kettle bottom 7 towards the heat chamber/kettle bottom opening 11 and enters the kettle side heat chamber 9 it becomes progressively heat depleted as it raises and transfers less heat from the kettle side heat chamber 9 through the outer kettle wall 8 until it reaches the heat chamber exhaust stack(s) 10 and departs the system. This loss of heat in the combustion exhaust gases is why the thermoplastic is coldest at the kettle top and is why circulating the hotter thermoplastic material from bottom of the melter kettle to top according to the present invention increases melting efficiency. The other conventional components of the melter shown in FIG. 1 include agitators 11 material feed hopper 12 agitator motor 13 and kettle material discharge port 14.

The thermoplastic melting kettle "circulation system" allows for bi-directional "circulation" of thermoplastic material in the vertical material transfer tube 15 between the bottom and top of the melter kettle 1. In this regard a reversible speed control motor 16 is provided that drives rotating auger 17 that extends within the vertical material transfer tube 15 so as to selectively move thermoplastic material either up or down, in or out, of a vertical material thermoplastic transfer tube 15. An outer insulation wall 18 surrounds the vertical material transfer tube 15 and sandwiches hi-temperature insulation against an outer wall 19 of a circulation system heat chamber 20.

The base of the melter kettle 1 is provided with a lower material transfer port 21 through which molten thermoplastic material can move in or out of the melter kettle 1. The melter kettle lid 22 is provided with an inlet port 23 that is connected to a horizontal material flow connector tube 24 through which molten thermoplastic material flows into the melter kettle from the vertical material transfer tube 15 by action of the bi-directional rotating auger 17. To the melter kettle lid 22 is attached a circulation system top mounting plate 25 securing the thermoplastic melter kettle circulation system 26 to the kettle top as shown in FIG. 1.

Figure 2:
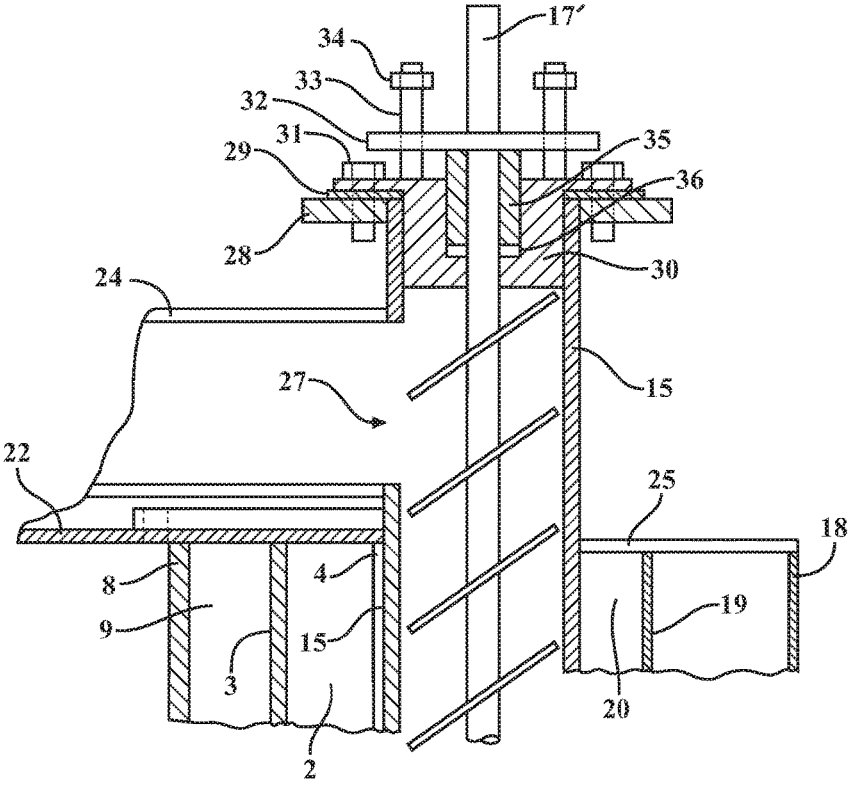
FIG. 2 is an enlarged side view of the top portion of the thermoplastic melting kettle circulation system of FIG. 1.

FIG. 2 is an enlarged side view of the top portion of the thermoplastic melting kettle circulation system of FIG. 1. As shown in FIG. 2 (and FIGS. 1 and 3) the vertical material transfer tube 15 is positioned adjacent the kettle outer insulation wall 4 and is held in place at the top by top mounting plate 25 which is connected to the kettle lid 22 as shown. Molten thermoplastic material can be drawn up, forced down or remain stationary in the vertical material transfer tube 15 as controlled by action of the reversible speed control motor 16 that is connected to the top of the bi-directional rotating auger 17. Molten thermoplastic material enters the melter kettle at the top through kettle lid upper material inlet port 23 (FIG. 1) as it flows from and through the horizontal material flow connector 24 that is connected to the vertical material transfer tube top material outlet port 27.

Referring to FIG. 2 a metal collar 28 having an ID that is slightly larger than the OD of the vertical material transfer tube 15 is attached (e.g., welded) to the top of and circles the top of the vertical material transfer tube 15. A gasket 29 is sandwiched between a stepped flange 30 that extends into the top of the vertical material transfer tube 15 and the metal collar 28 and compressed in place with bolts 31 to prevent molten thermoplastic material from leaking from between the metal collar 28 and stepped flange 30. An assembly with a ram plate 32 is positioned between two or more vertical studs 33 that are integrally attached to stepped flange 30 each having adjuster nuts 34 thereon provide downward force against an annular bushing 35 that compresses a gasket 36 against the auger shaft 17' to prevent thermoplastic from leaking around the auger shaft 17'.

Figure 3:
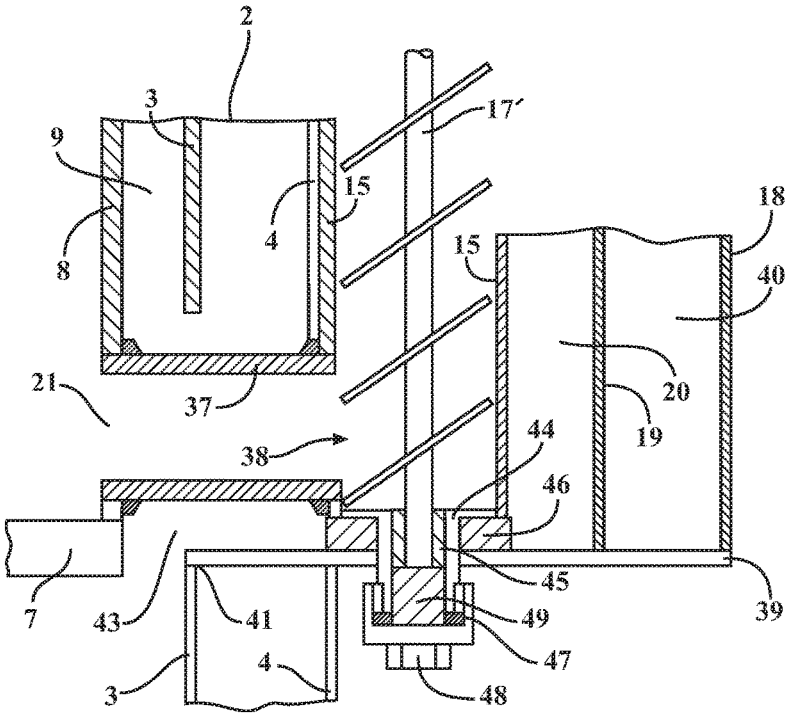
FIG. 3 is an enlarged side view of the bottom portion of the thermoplastic melting kettle circulation system of FIG. 1.

FIG. 3 is an enlarged side view of the bottom portion of the thermoplastic melting kettle circulation system of FIG. 1. As shown in FIG. 3 the vertical material transfer tube 15 rests adjacent the kettle outer insulation skin wall 4 is and held in place by welded connections at the bottom horizontal material transfer tube 37 to the lower bottom material transfer port 21 on the kettle side and to the vertical material transfer tube lower material inlet 38 on the vertical material transfer tube side.

A bottom mounting plate 39 is attached to and rests on the kettle outer heat chamber wall 3 opposed to the kettle bottom 7 and is also attached and rests on the kettle outer insulation wall 4. The bottom mounting plate 39 is attached to and seals off the bottom of the circulation system insulation chamber 40 and the bottom of the circulation system heat chamber 20. With the bottom mounting plate 39 attached to the outer heat chamber wall 3 at 41 below the bottom horizontal material transfer tube 37 and the bottom of the outer kettle heat chamber wall at 42 above the top of the horizontal material transfer tube 37 there is an opening 43 connecting the combustion chamber 5 with the system heat chamber 20 through which combustion gases from the combustion chamber 5 can pass to transfer heat into the vertical material transfer tube 15.

As shown in FIG. 3 the auger 17 is centered at the base of the vertical material transfer tube 15 to which there is attached a bottom tube flange 44 in which there is a bushing 45 and spacer 46 and gasket 47 with a threaded cap 48 that compresses the gasket 47 against the bottom of the bottom tube flange 44 preventing molten thermoplastic material leaks. Spacer 49 creates a greater standoff distance that allows heated air from the combustion chamber 5 into the bottom horizontal material transfer tube 37.

The thermoplastic material can degrade by overheating, too many heating/cooling cycles, being held at temperature for too long or not being agitated adequately. To prevent the thermoplastic material from scorching, baking or breaking down the auger 17 must be stationary as little as possible. During kettle melting start up if there is hard thermoplastic material in the kettle 1 there will be hard thermoplastic material in the vertical material transfer tube 15 at the same level. In this condition at start up the burner 6 will cycle on and off frequently to keep a lower temperature in the combustion chamber 5 than during production operating combustion chamber temperatures resulting in a gradual buildup of heat in the thermoplastic material in the vertical material transfer tube 15. As soon as the thermoplastic of the thermoplastic material reaches a temperature at which it has a low enough viscosity to be transferred by action of the auger 17 the auger 17 can transfer the thermoplastic material up in the material transfer tube 15 and enter kettle 1 through the kettle lid material inlet port 23. By reversing the direction of the auger 17 the molten thermoplastic material will be forced down the vertical material transfer tube 15 through the vertical material transfer tube bottom material transfer port 38 and through the bottom horizontal transfer tube 37 and though the kettle bottom material transfer port 21 and into the melter kettle 1. By rotating the auger 17 in this direction all thermoplastic material will be forced into and remain in the melter kettle 1 and there will be no thermoplastic material in the vertical material transfer tube 15 to degrade.

Figure 4:
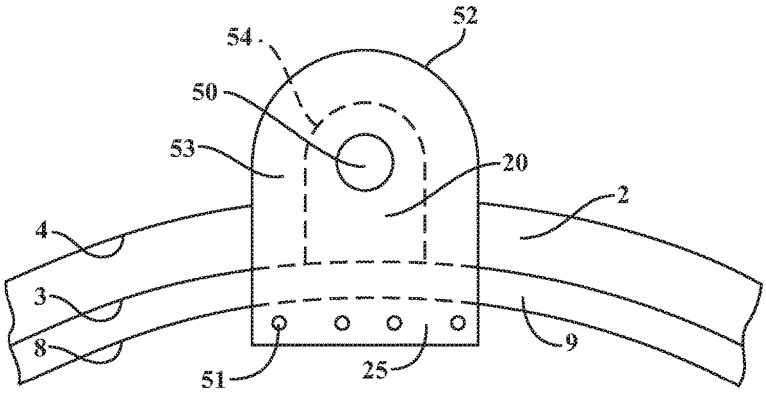
FIG. 4 is a sectional view taken along section lines IV-IV in FIG. 1.

FIG. 4 is a sectional view taken along section lines IV-IV in FIG. 1. FIG. 4 shows the transfer tube top mounting plate 25, the outer kettle wall 8, the outer heat chamber wall 3 outer insulation wall 4 and insulation chamber 2 that are discussed above and also shown in FIGS. 1 and 2. The vertical material transfer tube 15 is attached to hole 50 in the top mounting plate 25 and is positioned such that when the mounting plate 25 is attached to the kettle lid 22 through bolt holes 51 the top material outlet port 27 is vertically aligned with the horizontal material flow connector tube 24. At the top of and surrounding the vertical material transfer tube 15 is an extension 52 of the outer insulation wall 4 that encloses an extended insulation chamber 53 against an extended secondary heat chamber outer wall 54 that creates a system heat chamber 20 that is heated by heated combustion gases produced in the combustion chamber 5 that enter the system heat chamber 20 below the bottom horizontal material transfer tube 37. Heated combustion gases also enter the system heat chamber 20 through opening 43 that is provided above the outer kettle heat chamber wall 3 to the horizontal material transfer tube 37.

Figure 5:
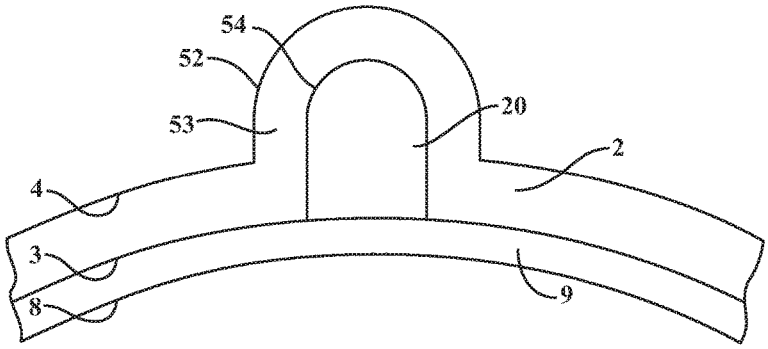
FIG. 5 is a sectional view taken along section lines V-V in FIG. 1.

FIG. 5 is a sectional view taken along section lines V-V in FIG. 1. The outer kettle wall 8, heat chamber 9 and outer heat chamber wall 3 shown in FIG. 5 extend continuously between the top mounting plate 25 and bottom mounting plate 39. The secondary heat chamber outer wall extension 54 extends from the outer heat chamber wall 3 surrounds and provides a heat chamber 52 for the vertical material transfer tube 15. A radial extension 52 of the outer insulation wall 4 surrounds the heat chamber wall extension 54 with an extended insulation chamber 53 for safety.

Figure 6:
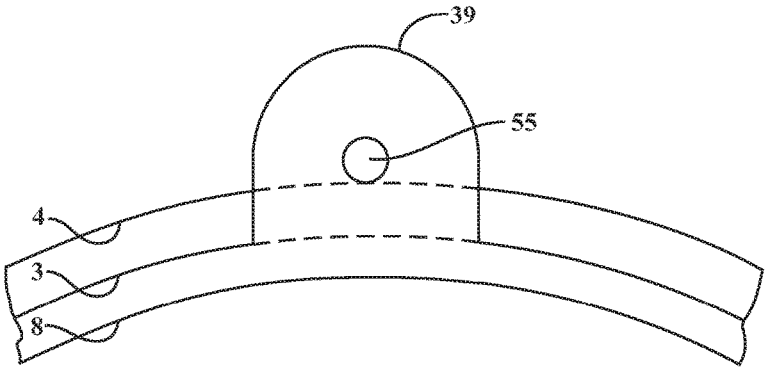
FIG. 6 is a sectional view taken along section lines VI-VI in FIG. 1.

FIG. 6 is a sectional view taken along section lines VI-VI in FIG. 1. FIG. 6 shows an extension of the bottom mounting plate 39 that includes a bottom plate locator hole 55 that is of a diameter just large enough for the bottom tube flange 44 to seat therein.

Figure 7:
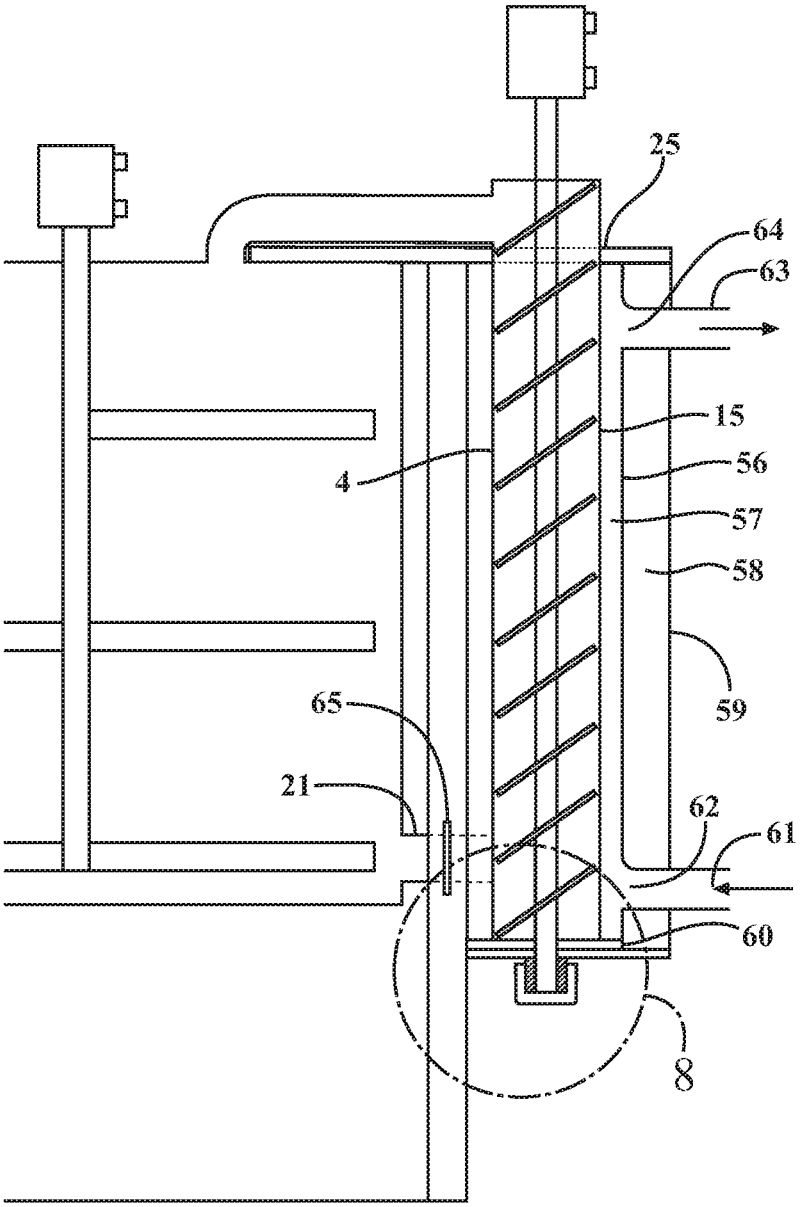
FIG. 7 is a cut away side view of a thermoplastic melter kettle having a thermoplastic melting kettle circulation system according to another embodiment of the present invention.

FIG. 7 is a cut away side view of a thermoplastic melter kettle having a thermoplastic melting kettle circulation system according to another embodiment of the present invention. The embodiment of the invention shown in FIG. 7 (and FIG. 8) is directed to an alternate method of heating the thermoplastic material in the vertical material transfer tube 15 which involves surrounding the vertical material transfer tube 15 by a larger diameter tube to create an outer oil bath heat chamber wall 56 that defines an oil bath heat chamber 57 that is attached to the outer kettle insulation wall 4. Around the oil bath heat chamber 57 is an extended insulation chamber 58. This extended insulation chamber 58 is incased by an extended outer insulation chamber wall 59.

Heat transfer oil is contained within the oil bath chamber 57 whereby the top of the vertical material transfer tube 15 and the top of the oil bath heat chamber outer wall 56 are welded to the bottom of the modified top mounting plate 25. More specifically a hole with an ID slightly larger than the OD of the vertical material transfer pipe 15 is provided in the top mounting plate 25 into which the vertical material transfer tube 15 is inserted and welded flush with the top of the top mounting plate 25. The structure and elements above the modified top mounting plate 25 are essentially the same as shown in the embodiment of the invention depicted in FIG. 2 and described above.

Figure 8:
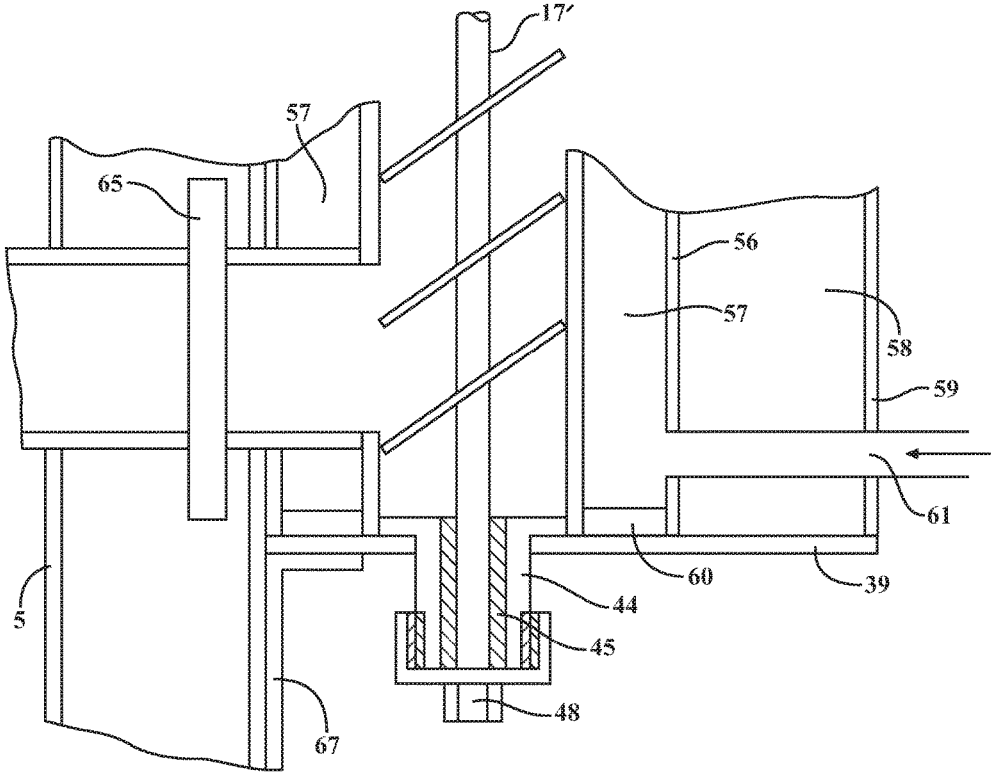
FIG. 8 is an enlarged side view of the bottom portion of the thermoplastic melting kettle circulation system of FIG. 7.

The bottom the vertical material transfer tube 15 and the outer oil bath heat chamber wall 56 are welded to a lower oil bath containment plate 60 as shown in FIG. 8 so as to prevent heat transfer oil leakage. An oil inlet tube 61 is welded to an oil inlet port 62 and oil outlet tube 63 is welded to oil outlet port 64 to supply oil to the oil bath 57.

The kettle bottom material outlet tube 21 is divided by and reconnected with a coupling flange 65 joining the two newly created sections to allow for connecting or disconnecting the unit. The tube side of the coupling flange 65 is welded to the kettle side outer oil bath heat chamber 57 to prevent oil leakage and is further welded to the vertical material transfer tube 15 to prevent molten thermoplastic material leakage. The system used for delivering heated oil to the oil bath heat chamber 57 can be any conventional type that is compatible with the function and location of the melter kettle 1. There are many types such oil heating systems available commercially.

FIG. 8 is an enlarged side view of the bottom portion of the thermoplastic melting kettle circulation system of FIG. 7. As shown in FIG. 8 a lower oil bath containment plate 60 is welded to each of the oil bath heat chamber wall 56, the vertical material transfer tube 15, the oil bath bottom tube flange 44, and the bottom oil inlet port tube 61 to prevent oil leakage.

The oil bath bottom tube flange 44 is provided with external threads that cooperate with internal threads on oil bath bottom cap 48 eliminating the need for gaskets to prevent thermoplastic from leaking at the base of the system. The bottom mounting plate 39 is connected at the kettle outer insulation wall 4 and is supported by a bracket 67. The base of the bottom tube flange 44 is centered in the bottom mounting plate 39 in the locator hole that is sized to support and stabilize the unit.

Figure 9:
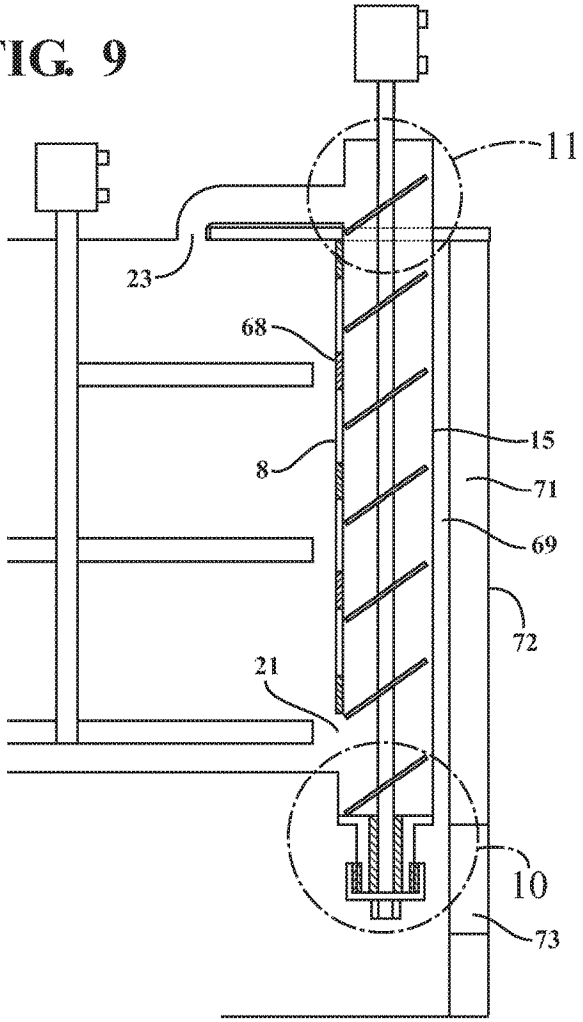
FIG. 9 is a cut away side view of a thermoplastic melter kettle having a thermoplastic melting kettle circulation system according to another embodiment of the present invention.

FIG. 9 is a cut away side view of a thermoplastic melter kettle having a thermoplastic melting kettle circulation system according to another embodiment of the present invention. In this embodiment the vertical material transfer tube 15 is connected directly to the outer kettle wall 8 outer shell of the kettle by weldments 68. Because of the direct connection of the vertical material transfer tube 15 at weldment points 68 to the outer kettle wall 8, in the embodiment it is not possible to completely encircle the vertical material transfer tube 15 by an outer heat chamber wall as in the other embodiments of the invention that are discussed above. In the embodiment of the invention shown in FIGS. 9-11 a vertical section of the outer heat chamber wall 3 is removed and reconfigured such that an extended heat chamber 69, similar to heat chamber 20 above, with an extended heat chamber wall 70 is created that encircles the attached vertical material transfer tube 15 by a uniform standoff distance. Additionally, the outer insulation chamber 59 in the embodiments above is reconfigured as an extended outer insulation chamber 71 and the outer insulation wall 4 in the embodiments above is reconfigured as the extended outer insulation wall 72. The tube assembly that includes the vertical material transfer tube 15 and auger 17 can extend partially or fully within the combustion chamber 5 and accessed through an access port 73.

Figure 10:
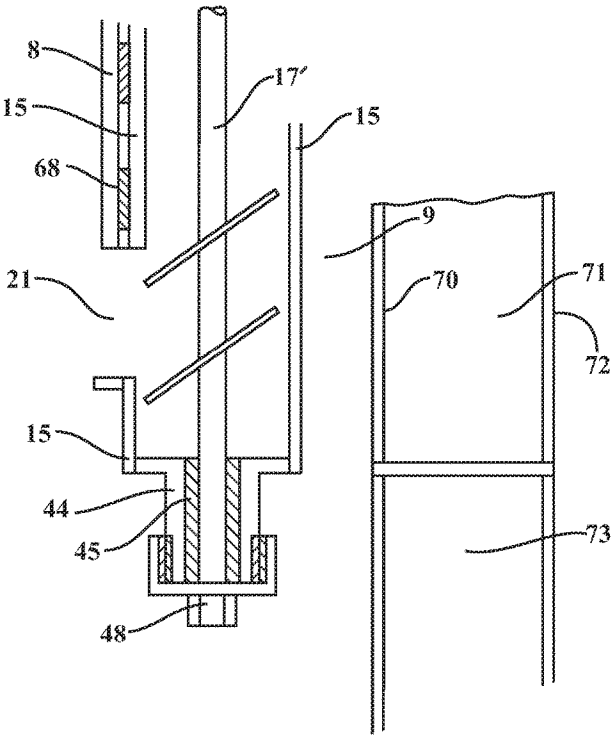
FIG. 10 is an enlarged side view of the bottom portion of the thermoplastic melting kettle circulation system of FIG. 9.

FIG. 10 is an enlarged side view of the bottom portion of the thermoplastic melting kettle circulation system of FIG. 9. As shown in FIG. 9 a tube bottom tube flange 44 with external threads is welded to the bottom of the vertical material transfer tube 15 sealing the intersection of those parts. The auger shaft 17' extends down through bushing 45 and rests on the bottom surface of an end cap 48 that has internal threads. In this mounting configuration the bottom interface assembly is located inside the combustion chamber 5 and can be accessed through a removable access port 73.

Figure 11:
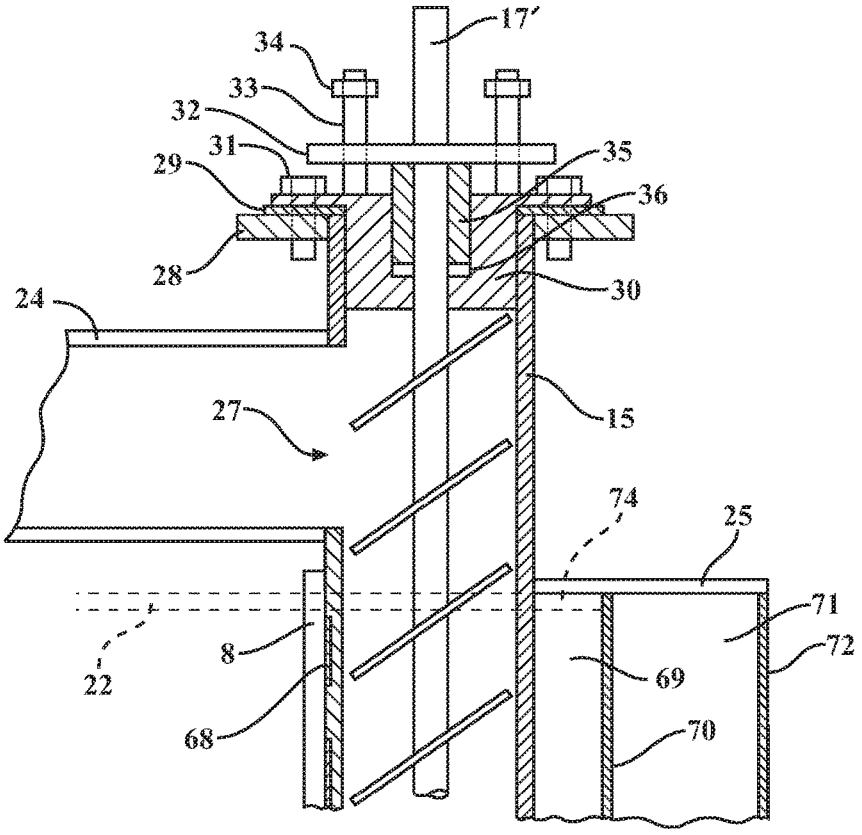
FIG. 11 is an enlarged side view of the top portion of the thermoplastic melting kettle circulation system of FIG. 9

FIG. 11 is an enlarged side view of the top portion of the thermoplastic melting kettle circulation system of FIG. 9. Elements identified in FIG. 11 by the same reference numerals in FIG. 2 are the same and provide the same functions as previously described in reference to FIG. 2 above. Directly across from and aligned with the kettle lid 22 is a cover plate 74 that is welded to the full periphery of the extended heat chamber 69 such that heated combustion chamber air is contained therein until it exhausts at one of the heat chamber exhaust stacks 10 (See FIG. 1). The top plate 25 acts to contain the insulation in the insulation chamber 71 and holds outer insulation wall 72 in place.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above and set forth in the attached claims.

The invention claimed is:

1. In a melter kettle for melting thermoplastic pavement marking material wherein the melter kettle is provided with a combustion chamber the improvement comprising a molten thermoplastic circulation system coupled to the melter kettle, the molten thermoplastic circulation system comprising:

a vertical material transfer tube in fluid communication with and extending between the bottom and top of the melter kettle for transferring molten thermoplastic material between the bottom and top of the melter kettle; and a heat chamber surrounding at least a portion of the vertical material transfer tube through which a heated fluid flows, wherein the melter kettle includes a first outlet port to which the vertical material transfer tube is coupled to provide the fluid communication with the bottom of the melter kettle; and the melter kettle includes a second outlet port through which molten thermoplastic material can be applied to a pavement, which second outlet port is separate from the first outlet port.

2. The melter kettle of claim 1, wherein the heat chamber is in fluid communication with the combustion chamber whereby hot combustion gases generated in the combustion chamber flow through the heat chamber.

3. The melter kettle of claim 1 further comprises a source of heated oil that flows through the heat chamber.

4. The melter kettle of claim 1, wherein the heat chamber surrounds substantially the entire circumferential periphery of the vertical material transfer tube.

5. The melter kettle of claim 1, wherein the heat chamber comprises a common heat chamber that surrounds the melter kettle and the vertical material transfer tube.

6. The melter kettle of claim 1, wherein the vertical material transfer tube is attached directly to an outer wall of the melter kettle.

7. The melter kettle of claim 6, wherein the heat chamber surrounds an outer portion of the vertical material transfer tube.

8. The melter kettle of claim 1, further comprising a heat dome chamber in the bottom of melter kettle.

9. A melter kettle for melting thermoplastic pavement marking material in combination with molten thermoplastic circulation system, wherein the molten thermoplastic circulation system comprises:

a vertical material transfer tube coupled to a side of the melter kettle and in fluid communication with and extending between the bottom and top of the melter kettle for transferring molten thermoplastic material between the bottom and top of the melter kettle; and a heat chamber surrounding at least a portion of the vertical material transfer tube through which a heated fluid flows wherein the melter kettle includes a first outlet port to which the vertical material transfer tube is coupled to provide the fluid communication with the bottom of the melter kettle; and the melter kettle includes a second outlet port through which molten thermoplastic material can be applied to a pavement, which second outlet port is separate from the first outlet port.

10. The combination of claim 9, wherein the heat chamber is in fluid communication with the combustion chamber whereby hot combustion gases generated in the combustion chamber flow through the heat chamber.

11. The combination of claim 9 further comprises a source of heated oil that flows through the heat chamber.

12. The combination of claim 9, wherein the heat chamber surrounds substantially the entire circumferential periphery of the vertical material transfer tube.

13. The combination of claim 9, wherein the heat chamber comprises a common heat chamber that surrounds the melter kettle and the vertical material transfer tube.

14. The combination of claim 9, wherein the vertical material transfer tube is attached directly to an outer wall of the melter kettle.

15. The combination of claim 14, wherein the heat chamber surrounds an outer portion of the vertical material transfer tube.

16. The combination of claim 9, wherein the melter kettle include a heat dome chamber in the bottom of melter kettle.

17. A method of melting a thermoplastic material in a melter kettle having a combustion chamber, said method comprising the steps of:

a) charging thermoplastic material into the melter kettle;

b) combusting a fuel source in the combustion chamber to heat and melt the thermoplastic material in the melter kettle;

c) removing molten thermoplastic material from the bottom of the melter kettle and transferring the removed molten thermoplastic material into the top of the melter kettle wherein the melter kettle is provided with a first outlet port through which the molten thermoplastic is removed from the bottom of the melter kettle and transferred into the top of the melter kettle in step c); and the melter kettle is provided with a second outlet port through which molten thermoplastic material can be applied to a pavement, which second outlet port is separate from the first outlet port.

18. The method of melting a thermoplastic material in a melter kettle according to claim 17, further comprising exhausting combustion gases from the combustion chamber through a heat chamber surrounding at least a portion of the vertical material transfer tube through which a heated fluid flows.

19. The method of melting a thermoplastic material in a melter kettle according to claim 17, further comprising circulating heated oil through the heat chamber.

20. The method of melting a thermoplastic material in a melter kettle according to claim 17, wherein the molten thermoplastic material is applied as a pavement maker.

* * * * *